US007644456B2

(12) United States Patent
Polevoy et al.

(10) Patent No.: US 7,644,456 B2
(45) Date of Patent: Jan. 12, 2010

(54) SLIDE LOCK FOR CENTER BEAM OF A BED FRAME

(75) Inventors: Richard S. Polevoy, Teaneck, NJ (US); Paul Eric Carlson, Skaneateles, NY (US)

(73) Assignee: Finger Lakes Intellectual Property LLC, Teaneck, NJ (US)

( * ) Notice: Subject to any disclaimer, the term of this patent is extended or adjusted under 35 U.S.C. 154(b) by 0 days.

(21) Appl. No.: 11/352,908

(22) Filed: Feb. 13, 2006

(65) Prior Publication Data

US 2006/0191071 A1 Aug. 31, 2006

Related U.S. Application Data

(60) Provisional application No. 60/652,321, filed on Feb. 11, 2005.

(51) Int. Cl.
*A47C 19/01* (2006.01)

(52) U.S. Cl. ..... 5/201; 5/203; 5/286

(58) Field of Classification Search ..... 5/203, 5/201, 207, 238, 305, 286
See application file for complete search history.

(56) References Cited

U.S. PATENT DOCUMENTS 3,761,971 A * 10/1973 Behnke ..... 5/201
6,625,827 B1 * 9/2003 Polevoy et al. ..... 5/203
6,851,140 B2 2/2005 Polevoy et al.

* cited by examiner

*Primary Examiner*—Fredrick Conley
(74) *Attorney, Agent, or Firm*—Klauber & Jackson L.L.C.

(57) ABSTRACT

A bed frame or other structural construction having a locking mechanism to allow two structural members to be affixed and locked together. A first structural member sits atop of the second structural member and has a pair of posts that interfit into a pair of holes formed in the second structural member. The locking mechanism is located at an end of the first structural member and includes a slide that is movable along the longitudinal axis of the first structural member to slide between a retracted, unlocked position and an extended, locked position where the slide contacts the lower surface of the second structural member to sandwich the second structural member between the first structural member and the slide to block the structural members from moving with respect to each to withdraw the posts from the holes, thereby locking the first and second structural members together.

27 Claims, 5 Drawing Sheets

SLIDE LOCK FOR CENTER BEAM OF A BED FRAME

REFERENCE TO RELATED APPLICATIONS

The present patent application is based upon and hereby claims priority to Provisional patent application Ser. No. 60/652,321, filed Feb. 11, 2005.

BACKGROUND OF THE INVENTION

The present invention relates to bed frames, and, more particularly, to a bed frame having a locking mechanism for affixing the center beam to the cross bars.

In general, bed frames are comprised of a pair of angle iron side rails and a plurality of cross bars that span between the side rails in order to assemble and complete the bed frame structure, forming a rectangle. Conventionally, the cross bars lock together by means of keyhole slots and standoff rivets that interlock with each other. The bed frame, once assembled is adapted to support a box spring and a mattress to make up the bed itself. Therefore, the conventional bed frame assembly is shipped and delivered unassembled for convenience and general transportation.

There is also, normally, a center beam that is positioned so as to be generally parallel to the side rails and which is located at or near the center of the bed frame in order to provide additional support to the overall structure and, of course to the box spring and mattress. The center beam is generally constructed of a pair of angle irons affixed together and the center beam is normally screwed into place between the cross bars. Stamped metal legs are permanently riveted at each corner of the resultant rectangle and at each end of the center beam in order to support the mattress and box spring off of the floor. The center beam is added to the bed frame to span between the cross bars in order to prevent the further relative movement between the cross bars as well as to secure the center beam into the bed frame to finalize the task of assembling that bed frame. The junction between the center beam and the cross bars must also be sufficiently stable and strong to minimize the tendency of the leg extending downwardly from the center beam to wobble in the direction of the longitudinal axis of the cross bars.

One of the difficulties with the conventional assembly of a bed frame, however, is that the center beam is normally affixed to the cross bars by means of screws, typically four screws with two at each end of the center beam, and therefore, the assembly of the bed frame requires extra pieces, i.e screws, a tool and a longer assembly time.

It would thus be advantageous to have a locking mechanism to allow the affixing of the center beam to the cross bars, and thus the assembly of the bed frame that did not require the use of tools, additional components, such as screws and which would simplify and speed up the assembly procedures and steps and yet be sufficiently strong to minimize the wobble of the leg extending downwardly from the center beam.

SUMMARY OF THE INVENTION

Now, in accordance with the present invention, there is provided a bed frame that includes a locking mechanism that affixes the ends of the center beam to the cross bars. The center beam itself has a T-shaped cross section having a horizontal flange and a vertical flange resulting from the joining together of a pair of L-shaped angle irons. At the ends of the center beam, however, the vertical flange is not present such that the ends of the center beam comprise only the horizontal flange.

With the present invention, there are locking mechanisms located at each of the ends of the center beam in order to carry out the affixation of the center beam between the cross bars without the use of need for tools or any separate components. As such, the locking mechanism of the present invention comprises a slide that is slidably affixed to the ends of the center beam. The slide is movable between a retracted, unlocked position and an extended, locked position and that movement of the slide can be effected by the hand of a user without the need for any tools and yet, the locking mechanism effectively affixes and locks the center beam to the cross bars.

The ends of the center beam also include a pair of posts that are permanently formed in the ends and extend downwardly therefrom. There are corresponding holes formed in the cross bars such that, in assembling a center beam of the present invention to the cross bars, the ends of the center beam can be positioned atop of the cross bar and lowered such that the posts pass through the holes in the cross bar to properly align the center beam with the cross bar and form a stable junction.

At this point, the user can grasp the slide by means of a downwardly extending member and move the slide relative to the center beam from its retracted, unlocked position to its extended, locked position where a forward extension of the slide forcefully engages the underside of the cross bar preventing the center beam from moving vertically upwardly to disengage the posts from the holes in the cross bar, thereby effectively locking the center beam to the cross bars without the need for tools or additional parts. The cross bars are effectively sandwiched between the center beam itself that is seated atop of the cross bars and the slide that engages the undersurface of the cross bars.

The forward extension of the slide, that is, the portion of the slide that contacts the underside of the cross bars, can be bifurcated to form two forward ends that are separately oriented and are preferable both located outboard of the center beam so as to resist the tendency of the leg extending downwardly from the center bean to wobble in the direction of the longitudinal axis of the cross bars. Thus, due to the distance between the two forward ends, or the width of the forward extension if the forward extension is not bifurcated, there is more stability of the leg in the side to side to direction.

As further features that can be included with the present invention, the forward extension of the slide can have one or more nipples that project upwardly and which engage the underside of the cross rails. In such manner, the contact between the forward extension of the slide and the cross rails can be at one or more points, as opposed to a surface area contact or even a line contact, which makes the sliding movement of the slide easier to carry out by the user moving from its extended, locked position to its retracted, unlocked position since there is little friction between the contact of the forward extension of the slide against the cross rails.

Other features of the present bed frame with the toolless locking mechanism for affixing the center beam to the cross bars will become more apparent in light of the following detailed description of a preferred embodiment thereof and as illustrated in the accompanying drawings.

DETAILED DESCRIPTION OF THE INVENTION

Figure 1:
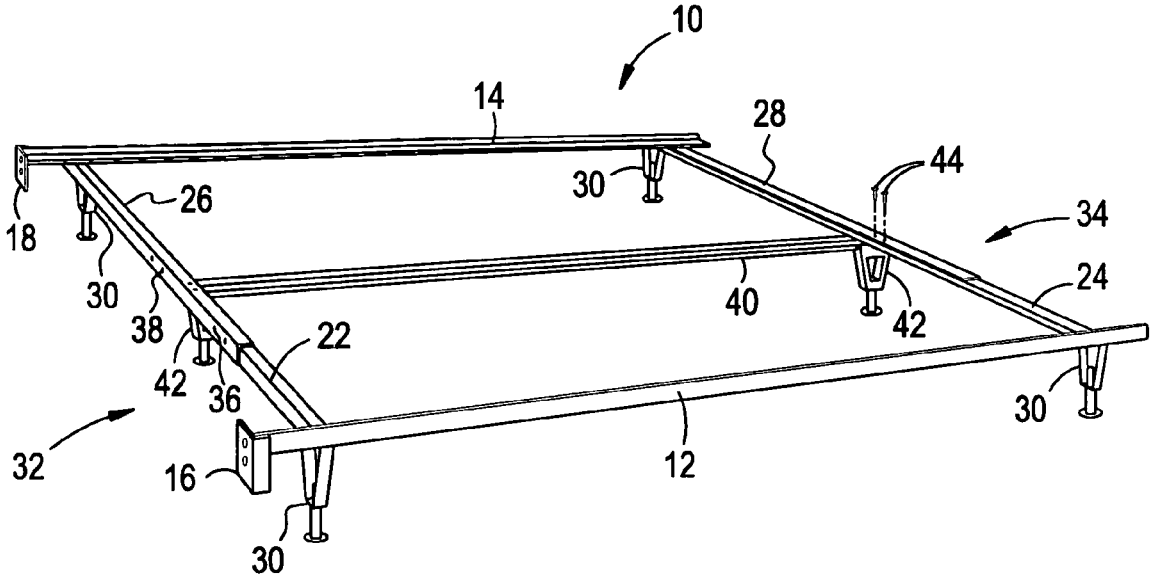
FIG. 1 PRIOR ART
FIG. 1 is a perspective view of a conventionally assembled bed frame for supporting a box spring and mattress.

Referring now to FIG. 1, there is shown a perspective view of a conventional bed frame 10. In the Figure, there are a pair of side rails 12, 14 that are normally L-shaped steel members and at one end thereof, there are located brackets 16, 18 to aid in the attachment of a headboard to the side rails 12, 14. To make up the bed frame 10, there are also cross bar members 22, 24, 26 and 28 that extend outwardly from side rails 12, 14 at about a right angle. For the convenience of handling and transportation of the components of a bed frame 10, the cross bar members 22, 24, 26 28 are pivotally mounted to the side rails 12, 14, that is, cross bar members 22 and 24 are pivotally mounted to the ends of side rail 12 while cross bar members 26 and 28 are pivotally affixed to the ends of side rail 14. As an example, therefore, during shipment, the cross bar members 22 and 24 are positioned 90 degrees from the orientation shown in FIG. 1 and rest parallel to and abut against the side rail 12 and, during assembly, the cross bar members 22 and 24 are rotated about 90 degrees to the position as shown.

Legs 30 extend downwardly from each of the cross bar members 22, 24, 26, 28 generally at or proximate to the pivot point between the cross bar member and the side rails 12, 14 and the legs 30 thereby provide the support for the bed frame 10 after the assembly thereof. As shown, the legs 30 are provided with glides that contact the floor, however, it can be seen that there may be rollers affixed to the underside of the legs that allow the bed frame to freely roll along the floor, and such rollers can be of the type shown and described in U.S. patent application Ser. No. 09/519,725, filed Mar. 3, 2000, entitled "CASTER ASSEMBLY FOR A BED FRAME MEMBER OR FURNITURE", now U.S. Pat. No. 6,568,031 and assigned to the assignee of the present invention.

Thus, during the assembly of the bed frame 10, the assembler rotates the cross bar members, 22, 26, for example, and affixes the free ends of those cross bar members 22, 26 together at about the center of the bed frame 10 in order to complete a cross bar 32. Since the same procedure will be used for the formation of the other cross bar 34, only the cross bar 32 will be hereinafter described in detail. The means for carrying out the joining of the cross bar members 22 and 26 together may be by a variety of mechanisms, one of which is shown in FIG. 1 and where one of the cross bar members 22 has a set or plurality of standoff rivets 36 facing outwardly and which interfit into a corresponding set of keyhole slots 38 formed in the mating cross bar member 26 by inserting the standoff rivets 36 through the enlarged area of the keyhole slots 38 and then moving one of the cross bar members 22, 26 relative to the other to slide the standoff rivets 36 into the narrow area of the keyhole slots 38 to secure the cross bar members 22 and 26 together. As indicated, the same procedure is used to secure the cross bar members 24 and 28 together in order to form the cross bar 34.

A center beam 40 is added to complete the bed frame 10 and which also has a pair of legs 42 and which provide overall support for the cross bars 32, 34 at the center of the bed frame 10. As can be seen, the center beam 40 spans between the two cross bars 32, 34 and is normally secured by means of screws 44 that are threaded into nuts, not shown, and which secure the center beam 40 to the cross bars 32, 34 as well as to secure the cross bar members 22, 26 and 24, 28 together to prevent relative motion between the mating cross bar members that might allow the cross bar members to come apart. As indicated, the use of screws adds a complication, however, as the assembler then needs to have tools to secure the bed frame 10 together and also the supplier needs to ship the appropriate screws and mating nuts, if captive nuts or Tinnerman clips are not used, along with each bed frame 10.

Figure 2:
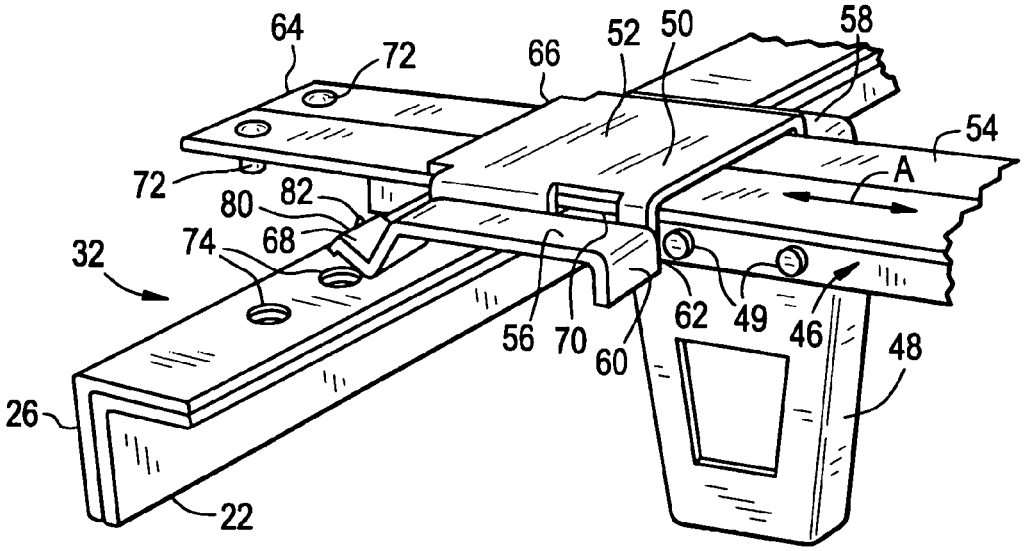
FIG. 2 is an exploded view of an end of a center beam of the present invention in position to be affixed to a cross bar.

Turning now to FIG. 2, taken along with FIG. 1, there is shown an exploded view illustrating the locking mechanism of the present invention utilized to affix a center beam 46 to a cross bar 32. The leg 48 extends downwardly from the center beam 46 to contact the floor to support the overall bed frame and the box spring and mattress resting on that bed frame. The leg 48 can be affixed to the center beam 46 by means of rivets 49 and therefore the side to side stability of the leg 48 is dependent upon the side to side stability of the center beam 46 as will be later explained.

As can be seen, the locking mechanism comprises a slide 50 that is slidably affixed to the center beam 46. The slide 50 can preferably be a stamped metal construction and has an upper portion 52 that overlies the upper surface of the horizontal flange 54 of the center beam 46 and a pair of outer portions 56, 58 extending outwardly therefrom. Each of the outer portions 56, 58 are formed in mirror image and include a downwardly extending portion 60 at a proximal end 62 of the slide 50, that is, the proximal end 62 of the slide 50 that is inward with respect to the end 64 of the center beam 46. At the distal end 66 of the slide 50 there is formed a forward extension 68 that will be later explained.

In order to conveniently affix the slide 50 to the center beam 46, there may be inwardly directed tabs 70, only one of which is shown in FIG. 2, that extend underneath the horizontal flange 54 of the center beam 46 to secure the slide 50 to the center beam 46 in a manner that the slide 50 can slidingly move along the longitudinal axis of the center beam 46 in the direction of the arrows A. Other methods of providing a sliding affixation of the slide 50 to the center beam 46 can, of course, be utilized.

As also can be seen, at or proximate to the end 64 of the center beam 46 there are a pair of posts 72 that extend downwardly therefrom. The posts 72 can be press fitted into suitable holes formed in the center beam 46 and therefore are firmly or permanently located in the center beam 46. The posts 72 are illustrated as comprising two posts 72, however, there may be only one post or more that two posts in carrying out the present invention.

Accordingly, when the center beam 46 is affixed to the cross bar 32, the posts 72 descend downwardly as the center beam 46 is rested atop of the cross bar 32 and the posts 72 fit into suitable shaped and located holes 74 formed in the cross bar 32 and, as can be seen, the holes 74 pass through both of the cross bar members 22, 26 that overlap in forming cross bar 32. Thus the end 64 of the center beam 46 is securely lodged in an affixed position to the cross bar 32 by means of the intermitting of the posts 72 into the holes 74.

The forward extension 68 of the slide 50 is preferably formed so as to make a firm contact with the lower surface of the cross bar 32 but configured so as to reduce the friction therebetween so that the user can easily move the slide 50 from its extended, locked position to its retracted, unlocked position without having to overcome considerable friction between the slide 50 and the lower surface of the cross bar 32. As such, therefore, the extended portion 68 is shaped in a generally laying down S-shaped configuration such that an upward edge 80 is formed that actually contacts the lower surface of the cross bar 32 in a line contact.

As a further enhancement to the reduction of friction between the slide 50 and the lower surface of the cross bar 32, there may be one or more nipples 82 that extend outwardly from the upward edge 80 and which contact the lower surface of the cross bar 32, thereby creating a contact at one or more points. The use of the S-shaped extended portion 68 also insures that there is an angled surface facing the cross bar 32 and not a straight edge to enable the forward extension 68 to ride up onto the lower surface of the cross bar 32 and exert a pressure against that surface. As will be later explained, it is noted that the location of the nipples 82 is outboard of the center beam 46.

Accordingly, in the construction of the bed frame, as can now be seen, the affixation of the center beam 46 to the cross bar 32 is secure and remains so during the use of the bed frame since there are no natural forces that tend to pull the components apart, that is, the center beam 46 is positioned atop of the cross bar 32 such that the weight of the box spring and mattress tend to secure that junction rather than to pull it apart. As such the affixation remains secure and does not tend to come apart.

Figure 3:
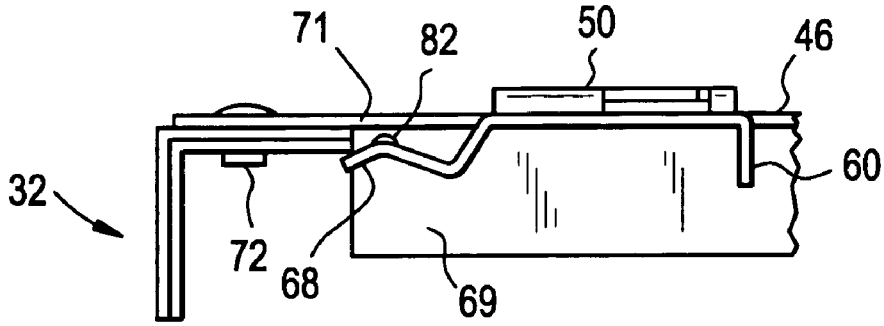
FIG. 3 is a side view of a center beam of FIG. 2 affixed to a cross bar with the locking mechanism of the present invention in its retracted, unlocked position.
Figure 4:
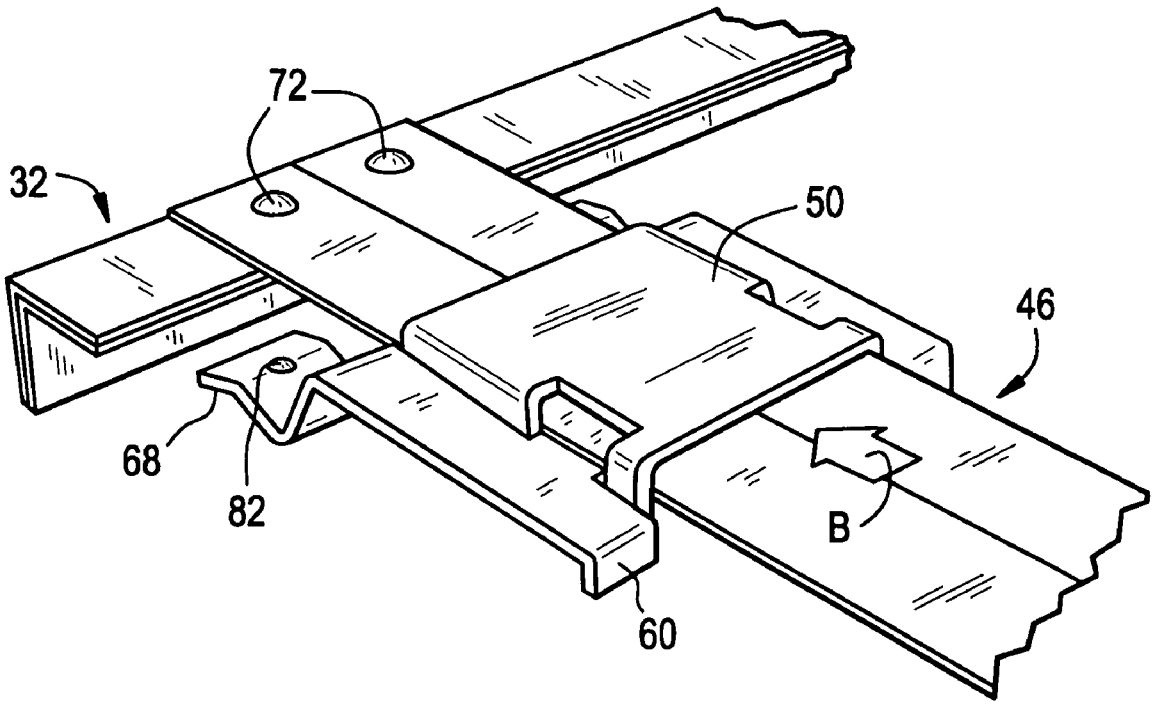
FIG. 4 is a perspective view of the center beam and cross bar of FIG. 3 with the locking mechanism of the present invention in its retracted, unlocked position.

Turning, therefore, to FIGS. 3 and 4, taken along with FIG. 2, there is shown a side view and a perspective view, respectively, of the center beam 46 in a position to be locked to the cross bar 32. As shown in FIGS. 3 and 4, the slide 50 is in its retracted, unlocked position where the forward extension 68 does not underlie or even contact the cross bar 32. Thus, in FIGS. 3 and 4, the posts 72 have been interfitted into the holes 74 such that the center beam 46 is affixed to the cross bar 32 but not locked onto that position. Therefore, in order to move the slide 50 from the retractable, unlocked position to the extended, locked position, the user simply manually grasps the downwardly extending portion 60 and pushes the slide 50 in the direction of the arrow B to lock the center beam 46 to the cross bar 32. There can also be seen, the nipple 82 that extends upwardly from the upward edge 80 to contact the underside of the cross bar 32.

It will be noted that the forward extension 68 is basically a bifurcated extension such that two separate forward ends are actually present in the embodiment and each may have a nipple formed therein so that the contact between the forward extension 68 of the slide 50 and the cross bar 32 may be a two point contact, it being understood that other embodiments can be constructed having one or more nipples to effect that contact with a minimum of friction therebetween. In addition it can be seen that the vertical flange 69 of the center beam 46 is cut back to enable the horizontal flange 71 of the center beam 46 to extend over and rest atop of the cross bar 32.

It is important that the spacing between the nipples 82 be relatively wide so as to minimize the potential wobble of the leg extending downwardly from the center beam 46 in the side to side direction, that is, the direction along the longitudinal axis of the cross bar 32. As can be seen, the side to side stability of the leg is dependent on the width of the contact between the slide 50 and the lower surface of the cross bar 32, that is, the wider the distance of the contact, the more stable the leg is with respect to side to side wobble. Thus, it is preferred that the nipples 82 actually contact the lower surface of the cross bar 32 outboard of the horizontal flange 71 of the center beam 46.

The width of the forward extension 68 should be, therefore, wider than the width of the horizontal flange 71 of the center beam 46. As indicated, while the use of spaced apart nipples 82 is preferred in order to make the movement of the slide 50 easier by reducing the friction, the forward extension 68 of the slide 50 may contact the underside of the cross bar 32 in a line contact, in which case, to provide stability to the leg and prevent side-to-side wobble of the leg 48 (FIG. 2), the width of the forward extension 68 is preferable wider than the width of the horizontal flange 71 of the center beam 46.

Figure 5:
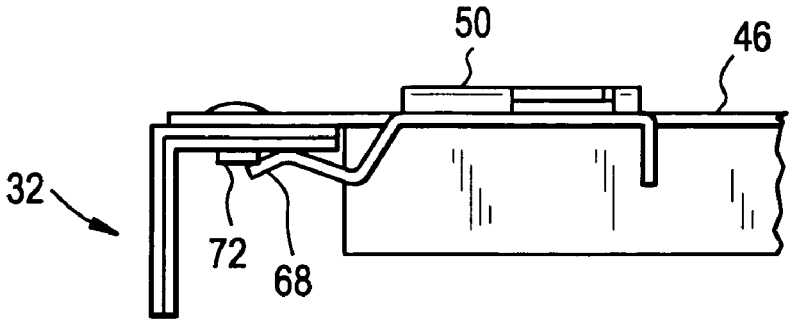
FIG. 5 is a side view of a center beam affixed to a cross bar with the locking mechanism of the present invention in its extended, locked position.
Figure 6:
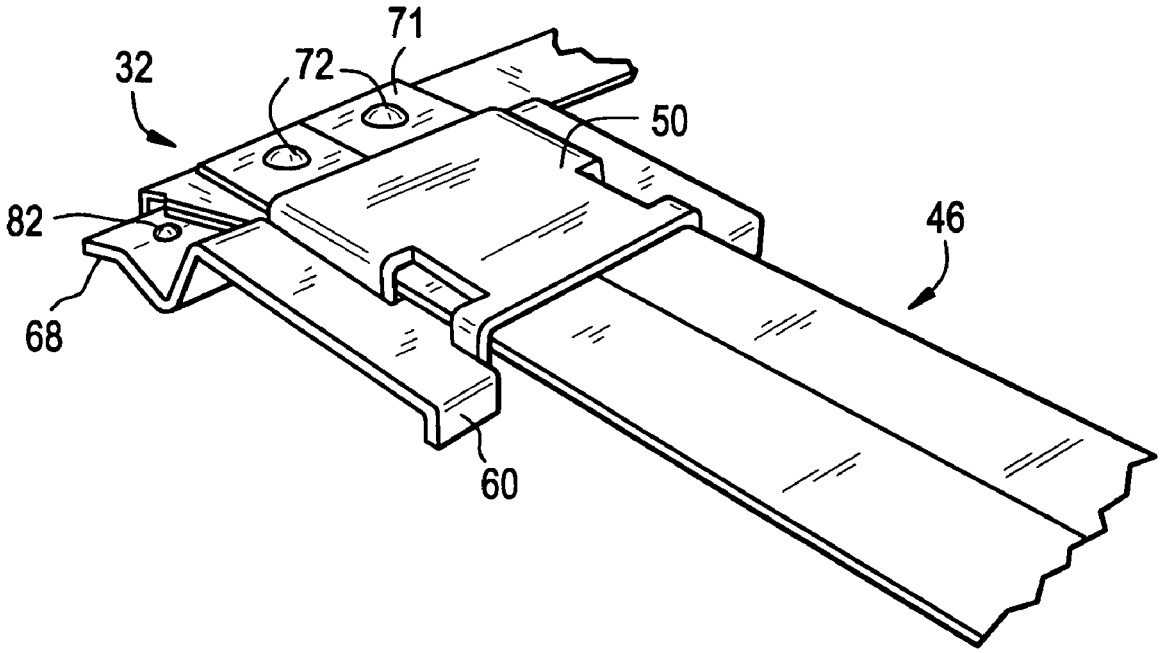
FIG. 6 is a perspective view of the center beam and cross bar of FIG. 5 with the locking mechanism of the present invention in its extended, locked position.

Turning, therefore, to FIGS. 5 and 6, taken along with FIG. 2, there is shown a side view and a perspective view, respectively, of the center beam 46 in its extended, locked position so as to lock the center beam 46 to the cross bar 32. As such, in FIG. 6, in particular, the nipple 82 can be seen to be contacting the underside of the cross bar 32 to minimize the friction between the slide 50 and the cross bar 32 so that the user, again, by using the downwardly extending portion 60 can easily move the slide 50 from the extended, locked position of FIGS. 5 and 6 to the retracted, unlocked position of FIGS. 3 and 4. Again, it should be noted that the nipple 82 contacts the lower surface of the cross bar 32 outboard of the horizontal flange 71 of the center beam 46.

Figure 7:
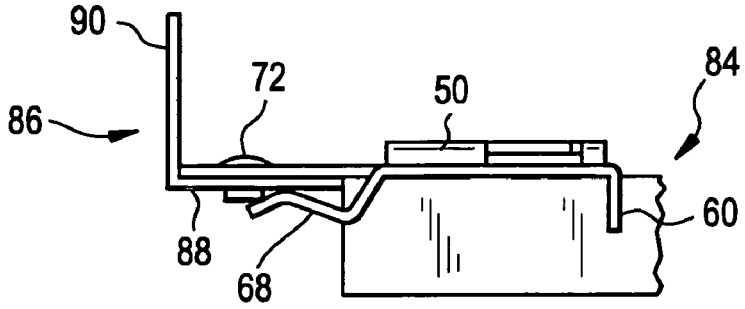
FIG. 7 is a side view of a alternate embodiment illustrating a cross member of a bed frame affixed to a side rail with the locking mechanism of the present invention in its extended, locked position.
Figure 8:
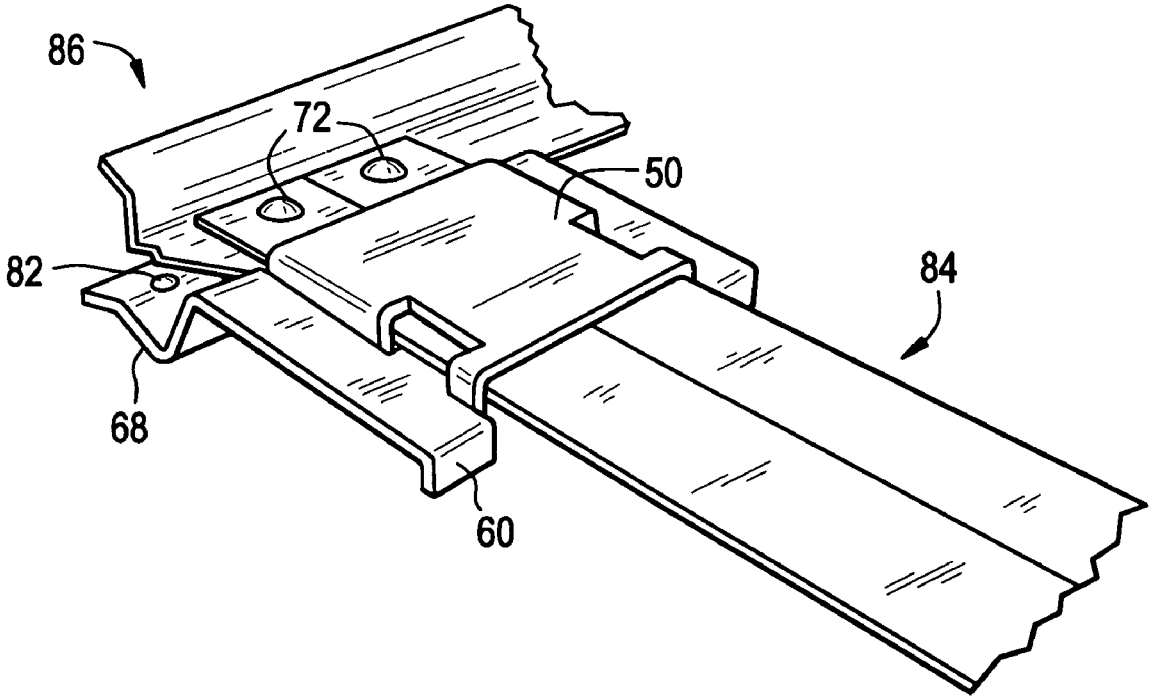
FIG. 8 is a perspective view of the cross member and side rail of FIG. 7 with the locking mechanism of the present invention in its extended, locked position.

In FIGS. 7 and 8 there is shown a side view and a perspective view, respectively, with the locking mechanism illustrated in its extended, locked position and being used to connect two structural members together. In FIGS. 7 and 8, the locking mechanism is used, for example to affix and lock a cross member 84 to a side rail 86 of a bed frame and illustrates the use of the present locking mechanism to assure a integral connection between two structural members. As can now be seen, the present invention has been previously described herein for use in securing the center beam of the cross bars in the assembly of a bed frame, however, it should be noted that the present locking mechanism could be used to lock other structural members and metal frames together including but not limited to shelves, metal braces, scaffolding and the like.

As such, in FIGS. 7 and 8, the side rail 86 is a L-shaped angle iron having a horizontal flange 88 where the box spring and mattress are supported and a vertical flange 90 that surrounds the lower edge of the box spring when the bed frame has been completed. Since the locking mechanism itself is the same as illustrated with respect to FIGS. 3-6, the same numbers have been used in FIGS. 7 and 8. Again, as with the prior embodiment, the slide 50 moves along the longitudinal axis of the cross member 84 in order to move between its extended, locked position as illustrated in FIGS. 7 and 8 and its retracted, unlocked position (not shown). Thus, in the extended, locked position, the forward extension 68 is positioned underneath the horizontal flange 88 to prevent the cross member 84 from moving upwardly to disengage the posts 72 from within the holes in the horizontal flange 88 of the side rail 86, thereby firmly affixing and locking the end of the cross member 84 to the side rail 86.

Figure 9:
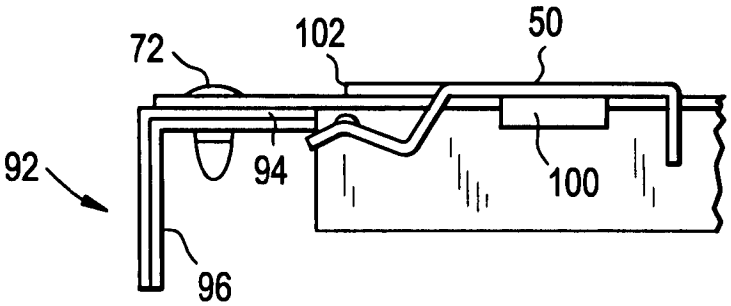
FIG. 9 is a side view of a still further alternate embodiment illustrating a cross member of a bed frame and a side rail with the locking means of the present invention in its retracted, unlocked position.
Figure 10:
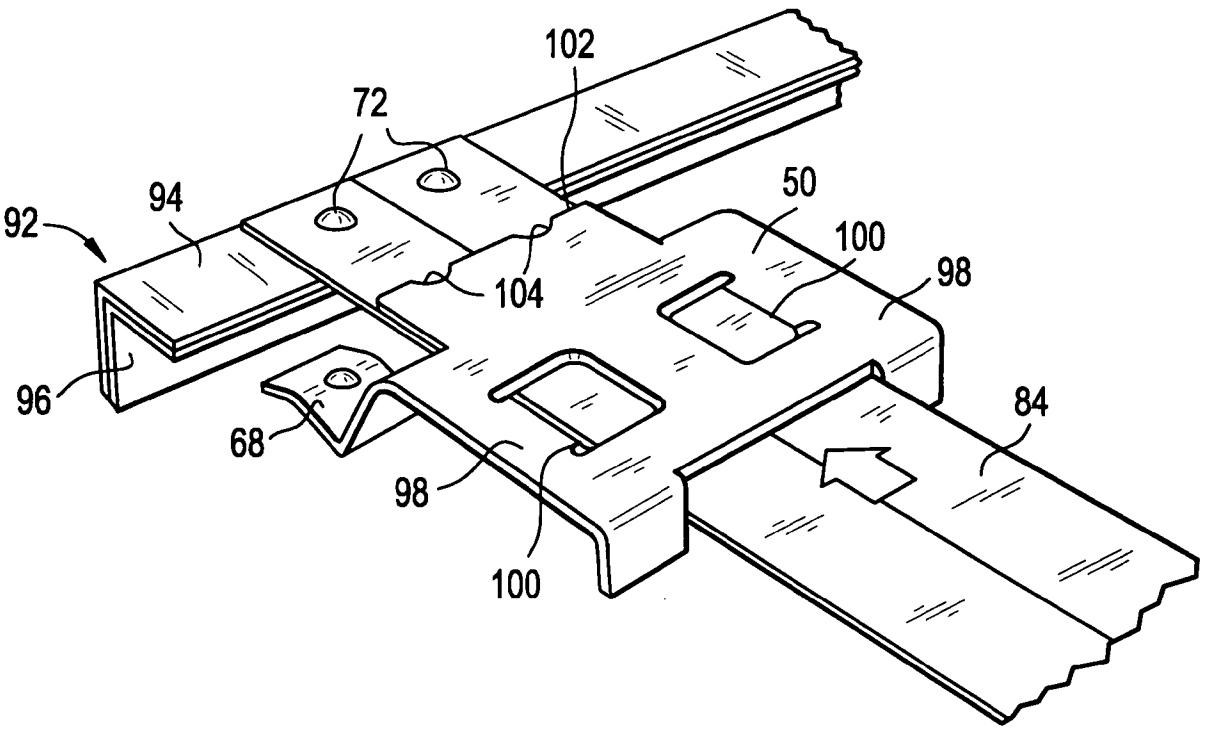
FIG. 10 is a perspective view of the cross member and side rail of FIG. 9 with the locking mechanism in its retracted, unlocked position.

Finally, in FIGS. 9 and 10, there is shown a side view and a perspective view, respectively, with the locking mechanism illustrated in its retracted, unlocked position and being used to connect two structural members together. In FIGS. 9 and 10, the locking mechanism is used, for example to affix and lock a cross member 84 to a cross bar 92 of a bed frame and further illustrates the use of the present locking mechanism to assure a integral connection between two structural members.

As such, in FIGS. 9 and 10, the cross bar 92 is an L-shaped angle iron having a horizontal flange 94 and a vertical flange 96. Again since the locking mechanism itself is the same as illustrated with respect to FIGS. 3-6, some of the same numbers have been used in FIGS. 9 and 10. Thus, as with the prior embodiment, the slide 50 moves along the longitudinal axis of the cross member 84 in order to move between its retracted, unlocked position as illustrated in FIGS. 9 and 10 and its extended, locked position (not shown). Thus, in the retracted, unlocked position, the forward extension 68 is positioned to be slid underneath the horizontal flange 94 to prevent the cross member 84 from moving upwardly to disengage the posts 72 from within the holes in the horizontal flange 94 of the cross bar 92, thereby firmly affixing and locking the end of the cross member 84 to the cross bar 92. As can be seen, preferably the posts 72 are tapered in order to facilitate their engagement with the holes in the horizontal flange 94.

As can be seed n FIGS. 9 and 10, however, in the embodiment, the lateral sides 98 of the slide 50 extend horizontally outwardly and there are tabs 100 that are cut inwardly and bent under the lower surface of the cross member 84. In addition, the forward edge 102 of the slide 50, that is, the edge of the slide 50 that moves toward the cross bar 92 when the slide 50 is moved to its extended, locked position, has a pair of semicircular indentations 104 formed therein. Accordingly when the slide 50 is moved into its extended, locked position, the circular heads of the posts 72 enter into and seat within those indentations 104. Therefore, when the slide 50 of the embodiment of FIGS. 9 and 10 is in its extended, locked position it is clear to the user by a simple visual inspection to verify that the posts 72 are seated within the indentations 104, that the slide 50 is indeed properly secured in the extended, locked position While the present invention has been set forth in terms of a specific embodiment or embodiments, it will be understood that the present bed frame having a locking mechanism to affix the center beam to cross bars herein disclosed may be modified or altered by those skilled in the art to other configurations. Accordingly, the invention is to be broadly construed and limited only by the scope and spirit of the claims appended hereto.

We claim:

1. A bed frame assembly comprising:

a pair of generally parallel, spaced apart, side rails having horizontal surfaces for supporting a box spring and a mattress, cross bars interconnecting and spanning between said side rails to form a bed frame, said cross bars having lower surfaces, and a center beam having opposed ends positioned atop of said cross rails generally intermediate and parallel to said side rails, the center beam having an upper surface and a lower surface and having a locking mechanism at each of the opposed ends thereof to attach the opposed ends of the center beam to said cross bars, said locking mechanism comprising a slide slidably attached to the end of the center beam, said slide having an upper surface and a lower surface overlying the upper surface of the center beam and slidingly secured thereto by inwardly directed tabs that extend underneath the lower surface of the center beam such that the upper and lower surfaces of the slide move along a horizontal plane that is parallel to the upper and lower surfaces of the center beam, said slide having a forward extension, said slide being movable with respect to said cross bars between a retracted, unlocked position and an extended, locked position where the forward extension of the slide moves into engagement with the lower surface of the cross bar to sandwich the cross bar between said center beam and said slide.

2. The bed frame assembly as defined in claim 1 wherein the forward extension is bifurcated into a pair of ends that engage the lower surface of the cross bar.

3. The bed frame assembly as defined in claim 1 wherein the center beam is a T-shaped cross section having a horizontal flange and a vertical flange and the slide is slidably affixed to the horizontal flange of the T-shaped center beam.

4. The bed frame assembly as defined in claim 1 wherein the center beam is a T-shaped cross section having a horizontal flange and the forward extension bifurcated into a pair of ends that contact the lower surface of the cross bar outboard of the horizontal flange.

5. The bed frame assembly as defined in claim 1 wherein the slide is general S-shaped having an edge formed therein that contacts the lower surface of the cross bar.

6. The bed frame assembly as defined in claim 1 wherein the slide has at least one nipple extending therefrom that contacts the lower surface of the cross bar.

7. The bed frame assembly as defined in claim 1 wherein the cross bars have at least one hole formed therein and the ends of the center beam have at least one post extending downwardly therefrom that interfits into the at least one hole formed in the cross bars.

8. The bed frame assembly as defined in claim 7 wherein the cross bars have a pair of spaced apart holes formed therein and the ends of the center beam have a pair of posts extending downwardly therefrom that interfit into the pair of holes formed in the cross bars.

9. The bed frame assembly as defined in claim 1 wherein the slide has a forward edge having at least one indentation that interfits with the at least one post to provide a visual indication that the slide is in its extended, locked position.

10. The bed frame assembly as defined in claim 1 wherein the slide has at least one downwardly extending member accessible to a user to manually move the slide between the retracted and extended positions.

11. A structural assembly comprising:

a pair of generally parallel, spaced apart, first structural members having upper surfaces and lower surfaces, a second structural member having ends interconnecting and spanning between said pair of first structural members, the second structural member having upper and lower surfaces, each of the ends of said second structural member resting atop of the upper surfaces of the first structural members and having a locking mechanism, said locking mechanism having a slide that is affixed to the second structural member, said slide having an upper surface and a lower surface overlying the upper surface of the second structural member and having inwardly directed tabs that extend underneath the lower surface of the second structural member to slidingly secure the slide to the second structural members such that the upper and lower surfaces of the slide move along a horizontal plane that is parallel to the upper and lower surfaces of the second structural member, the slide being movable with respect to said first structural members between a retracted, unlocked position and an extended, locked position wherein the slide moves into contact with the lower surface of the first structural member to sandwich the first structural member between the second structural member and the slide to attach the ends of the second structural members to said pair of first structural members.

12. The structural assembly of claim 11 wherein the structural assembly is a bed frame assembly.

13. The structural assembly as defined in claim 12 wherein said pair of first structural members comprises side rails of the bed frame assembly.

14. The structural assembly as defined in claim 12 wherein said pair of first structural members comprises cross members of the bed frame assembly.

15. The structural assembly as defined in claim 11 wherein each first structural member has at least one hole in the upper surface, and each end of a second structural member has at least one post depending downwardly therefrom adapted to interfit into the at least one hole of the first structural member when the one end of the second structural member is positioned atop of the upper surface of the first structural member, said locking mechanism comprising a slide slidably affixed to the second structural member and movable along the longitudinal axis of the second structural member between a retracted, unlocked position and an extended, locked position where the slide contacts the lower surface of the first structural member to prevent the second structural member from moving upwardly to withdraw the at least one post from the at least one hole in the first structural member.

16. The structural metal frame assembly as defined in claim 15 wherein the at least one post comprises a pair of spaced apart posts and the at least one hole in the first structural member comprises a pair of holes.

17. The structural metal frame assembly as defined in claim 15 wherein the slide has a forward edge having at least one indentation that interfits with the at least one post to provide a visual indication that the slide is in its extended, locked position.

18. A first structural member adapted to be affixed to a second structural member having an upper surface and a lower surface and at least one hole therethrough, said first structural member having at least one post extending downwardly therefrom and adapted to enter said at least one hole in said second structural member when said first structural member is resting atop of the upper surface of the second structural member, said first structural member having an upper surface and a lower surface and having a locking mechanism at an end thereof, said locking mechanism comprising a slide having an upper surface and a lower surface overlying the upper surface of the first structural member and having inwardly directed tabs that extend underneath the lower surface of the first structural member to slidingly secure the slide to the first structural member, the slide being slidably movable along the longitudinal axis of the first structural member with respect to said second structural member and having a forward extension, said slide being movable between a retracted, unlocked position and an extended, locking position wherein the upper and lower surfaces of the slide move in a plane that is parallel to the plane of the upper and lower surfaces of the first structural member and said forward extension moves into contact with the lower surface of the second structural member to prevent withdrawal of the at least one post from the at least one hole of the second structural member.

19. The first structural member as defined in claim 18 wherein the first structural member is a center beam of a bed frame and said second structural member is a cross bar of a bed frame.

20. The first structural member as defined in claim 19 wherein the center beam has a predetermined width and the slide is dimensioned to contact the lower surface of the cross bar at opposite locations outboard of the width of the center beam.

21. The first structural member as defined in claim 18 wherein the forward extension is general S-shaped having an upward edge formed therein that contacts the lower surface of the second structural member.

22. The first structural member as defined in claim 18 wherein the forward extension has at least one nipple extending upwardly thereof to contact the lower surface of the second structural member.

23. The first structural member as defined in claim 22 wherein said first structural member has a T-shaped cross section with a horizontal flange and said at least one nipple comprises two nipples both located outboard of the horizontal flange of the first structural member.

24. A structural metal frame assembly comprising:

a first structural member having an upper surface and a lower surface and at least one hole therethrough, a second structural member having an upper surface and a lower surface and having a locking mechanism located at least one end thereof for affixing the end of the second structural member to the first structural member, said second structural member having at least one post depending downwardly therefrom adapted to interfit into the at least one hole of the first structural member when the one end of the second structural member is positioned atop of the upper surface of the first structural member, said locking mechanism comprising a slide having an upper surface and a lower surface overlying the upper surface of the second structural member and having inwardly directed tabs that extend underneath the lower surface of the second structural member such that the upper and lower surfaces of the slide mover along a horizontal plane that is parallel to the upper and lower surfaces of the second structural member to slidingly secure the slide to the second structural member, the slide being slidably affixed to the second structural member and movable along the longitudinal axis of the second structural member with respect to said first structural member between a retracted, unlocked position and an extended, locked position where the slide moves into contact with the lower surface of the first structural member to prevent the second structural member from moving upwardly to withdraw the at least one post from the at least one hole in the first structural member.

25. The structural metal frame assembly as defined in claim 24 wherein the at least one post comprises a pair of posts and the at least one hole in the first structural member comprises a pair of holes.

26. A bed frame assembly comprising:

a pair of generally parallel, spaced apart, side rails having horizontal surfaces for supporting a box spring and a mattress, cross bars interconnecting and spanning between said side rails to form a bed frame, said cross bars having lower surfaces, and a center beam having opposed ends and having an upper surface and a lower surface positioned atop of said cross bars generally intermediate and parallel to said side rails, the center beam having a locking mechanism at each of the opposed ends thereof to attach the opposed ends of the center beam to said cross bars, said locking mechanism comprising a slide slidably attached to the end of the center beam, said slide having a forward extension, said slide being movable with respect to said cross bars along a plane that is parallel to the upper and lower surfaces of the center beam between a retracted, unlocked position and an extended, locked position where the forward extension of the slide moves into engagement with the lower surface of the cross bar to sandwich the cross bar between said center beam and said slide, wherein the slide is general S-shaped having an edge formed therein that contacts the lower surface of the cross bar.

27. A first structural member adapted to be affixed to a second structural member having an upper surface and a lower surface and at least one hole therethrough, said first structural member having at least one post extending downwardly therefrom and adapted to enter said at least one hole in said second structural member when said first structural member is resting atop of the upper surface of the second structural member, said first structural member having an upper surface and a lower surface and a locking mechanism at an end thereof, said locking mechanism comprising a slide slidably movable along the longitudinal axis of the first structural member with respect to said second structural member and having a forward extension, said slide being movable along a plane that is parallel to the upper and lower surfaces of the first structural member between a retracted, unlocked position and an extended, locking position wherein the forward extension moves into contact with the lower surface of the second structural member to prevent withdrawal of the at least one post from the at least one hole of the second structural member, wherein the forward extension is generally S-shaped having an upward edge formed therein that contacts the lower surface of the second structural member.

* * * * *